US008056736B2

(12) United States Patent
Dientsmann et al.

(10) Patent No.: US 8,056,736 B2
(45) **Date of Patent: *Nov. 15, 2011**

(54) GOLF CLUB HOLDER AND DISPLAY

(75) Inventors: Rodrigo R. Dientsmann, Chicago, IL (US); David A. Forte, Lisle, IL (US); Walter R. Miranda, Hawthorn Woods, IL (US)

(73) Assignee: Cormark, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,413

(22) Filed: Mar. 31, 2011

(65) Prior Publication Data

US 2011/0174751 A1 Jul. 21, 2011

Related U.S. Application Data

(63) Continuation of application No. 11/933,844, filed on Nov. 1, 2007, now Pat. No. 7,938,278.

(60) Provisional application No. 60/858,526, filed on Nov. 13, 2006, provisional application No. 60/858,556, filed on Nov. 13, 2006, provisional application No. 60/859,272, filed on Nov. 15, 2006.

(51) Int. Cl.
*A63B 55/00* (2006.01)

(52) U.S. Cl. ..... 211/70.2; 211/85.7; 211/87.01; 248/309.1

(58) Field of Classification Search ..... 211/85.7, 211/60.1, 62, 63, 64, 68, 70.2, 70.5, 70.8, 211/70.6, 87.01, 94.01, 106.01; 248/512, 248/534, 539, 214, 224.8, 309.1, 312, 314, 248/110, 111; 206/315.2, 315.6
See application file for complete search history.

(56) References Cited

U.S. PATENT DOCUMENTS

| | | | | |
|---|---|---|---|---|
| 532,953 | A * | 1/1895 | Grimes | 211/62 |
| 715,563 | A * | 12/1902 | Doublat | 211/1 |
| 760,866 | A * | 5/1904 | Hohoff | 211/63 |
| 1,117,491 | A | 11/1914 | Hornung | |
| 1,719,360 | A * | 7/1929 | Deike | 211/68 |
| 3,483,996 | A * | 12/1969 | Scammon | 294/143 |
| 4,696,122 | A * | 9/1987 | Van Der Zyl | 43/21.2 |
| 5,636,734 | A * | 6/1997 | Smith | 206/315.2 |
| 5,687,856 | A | 11/1997 | Kendrena | |
| 6,142,920 | A | 11/2000 | Ogura | |
| 6,161,691 | A * | 12/2000 | Ratcliff et al. | 206/315.2 |
| 6,244,438 | B1 * | 6/2001 | Weinmeier | 206/315.6 |
| 6,352,154 | B1 * | 3/2002 | Miura | 206/315.6 |
| 6,394,287 | B2 | 5/2002 | Cabrera | |
| 6,415,932 | B1 * | 7/2002 | Fiscus et al. | 211/64 |
| 6,536,588 | B1 * | 3/2003 | Kyrwood | 206/315.6 |

(Continued)

FOREIGN PATENT DOCUMENTS

JP 2004-136069 A 5/2004

*Primary Examiner* — Darnell Jayne
*Assistant Examiner* — Stanton L Krycinski
(74) *Attorney, Agent, or Firm* — Levenfeld Pearlstein, LLC

(57) ABSTRACT

A golf club holder and display adaptable to the desired configuration of the user. The display includes a support member and a cradle, with the cradle being adjustably removable relative to the support member. The support member may accept different numbers and types of cradles, and the user can select the cradles based on the desired display configuration. The golf club holder and display is also adaptable to supporting both right-handed and left-handed golf clubs.

8 Claims, 11 Drawing Sheets

U.S. PATENT DOCUMENTS 6,575,311 B1 * 6/2003 Fink ..... 211/70.2
D483,427 S 12/2003 Lim
6,932,312 B1 * 8/2005 Chen ..... 248/316.1
7,014,052 B2 * 3/2006 Dettorre et al. ..... 211/85.7
7,114,622 B2 * 10/2006 Miranda et al. ..... 211/70.2
7,896,173 B2 * 3/2011 Yamamoto et al. ..... 211/70.2
2004/0155000 A1 * 8/2004 Mele et al. ..... 211/4
2006/0011566 A1 * 1/2006 Guy ..... 211/60.1
2007/0158283 A1 * 7/2007 Yamamoto et al. ..... 211/70.2
2007/0193965 A1 * 8/2007 Cialdella et al. ..... 211/70.2

* cited by examiner

GOLF CLUB HOLDER AND DISPLAY

CROSS-REFERENCE TO RELATED APPLICATION DATA

This application is a continuation of U.S. patent application Ser. No. 11/933,844, filed Nov. 1, 2007, now U.S. Pat. No. 7,938,278, which claims the benefit of priority of U.S. Provisional Patent Application No. 60/858,526, filed Nov. 13, 2006, U.S. Provisional Patent Application No. 60/858,556, filed Nov. 13, 2006, and U.S. Provisional Patent Application No. 60/859,272, filed Nov. 15, 2006.

FIELD OF THE INVENTION

The present invention relates to a holder and display rack for golf clubs. More specifically, the present invention is directed towards a golf club display rack with removable cradles which allow the user to customize the appearance and function of the display rack.

BACKGROUND OF THE INVENTION

Many types of golf club display racks are available in the prior art. Available racks use various methods to hold and display the golf clubs. For example, there exist golf club racks that display the clubs where the golf club hangs from the head with the shaft hanging down. These racks are advantageous in that it allows for easy browsing of the golf clubs mounted on the rack, allowing the customer to quickly find the golf club desired.

An example of a golf club rack that displays the club upside down is a rack where the club heads are held in place by providing an upper and lower surface to support the head and part of the shaft, respectively. In this type of display, however, the display rack is not adaptable to accommodate different assortments of clubs depending on the desired selection that the golf club vendor wishes to display. Rather, the golf club vendor is forced to display only an assortment of clubs that will fit into the existing racks.

Another example of a golf club rack is a display that supports golf club heads using a cradle with arcuate arms and a trough. The golf club cradles used with this type of display, however, are limited in that a specific type of cradle must be used with this display, and therefore the rack is not adaptable to a variety of different environments and preferences.

Therefore, there is a need in the art for a golf club display rack operable with multiple cradle designs to maximize versatility. Further, the golf club rack should keep golf club heads organized and protected, making it unnecessary for a user to spend time spinning the golf club heads to find the model desired. The golf clubs should appear organized, neat and professional, and allow for easy viewing of shaft options. Finally it is desired to have a display rack that allows easy removal of the golf clubs from the display and it does not require lifting of clubs out of tubes as in previous devices.

SUMMARY OF THE INVENTION

In one embodiment, a display for holding and displaying golf clubs comprises a support member and a cradle, with the cradle being adjustably removable relative to the support member.

In another embodiment, a display for holding and displaying golf clubs comprises a support member and a cradle, the cradle being adjustably removable relative to the support member, the cradle having a first receiving slot and a second receiving slot, a first arm and a second arm, and a recess formed in the space between the first arm and the second arm.

In another embodiment, a display for holding and displaying golf clubs comprises a support member and a cradle, the cradle being adjustably removable relative to the support member, where the cradle comprises a mount enabling the cradle to be slidably attached to the support member.

In yet another embodiment, a display for holding and displaying golf clubs comprises an arcuate support member comprising at least one cradle.

BRIEF DESCRIPTION OF THE DRAWINGS

The features of the present invention which are believed to be novel are set forth with particularity in the appended claims. The benefits and advantages of the present invention will become more readily apparent to those of ordinary skill in the relevant art after reviewing the following detailed description and accompanying drawings, wherein:

DETAILED DESCRIPTION OF THE INVENTION

Figure 1:
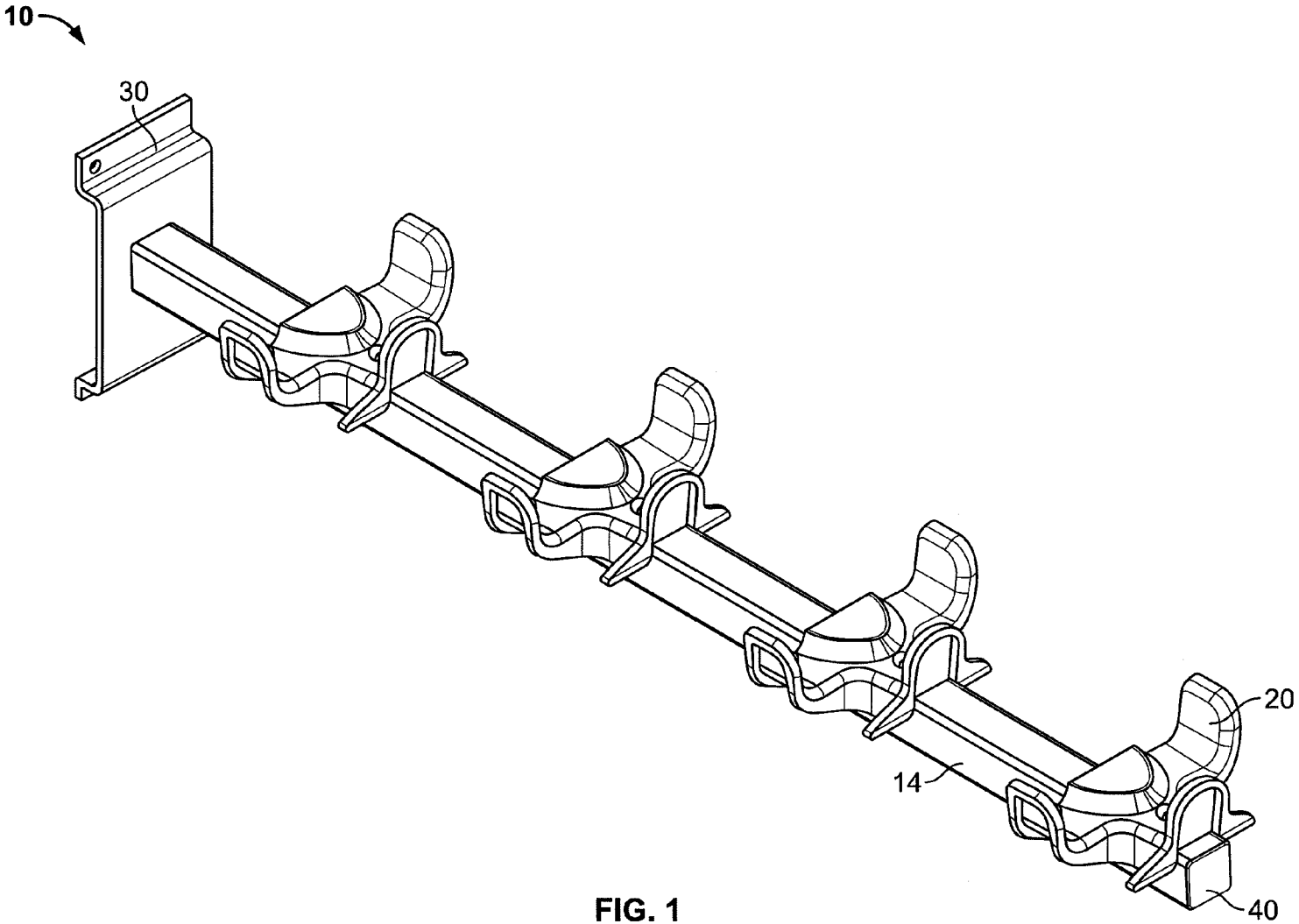
FIG. 1 shows a golf club holder and display, a support member and a plurality of cradles according to one embodiment of the invention.
Figure 2:
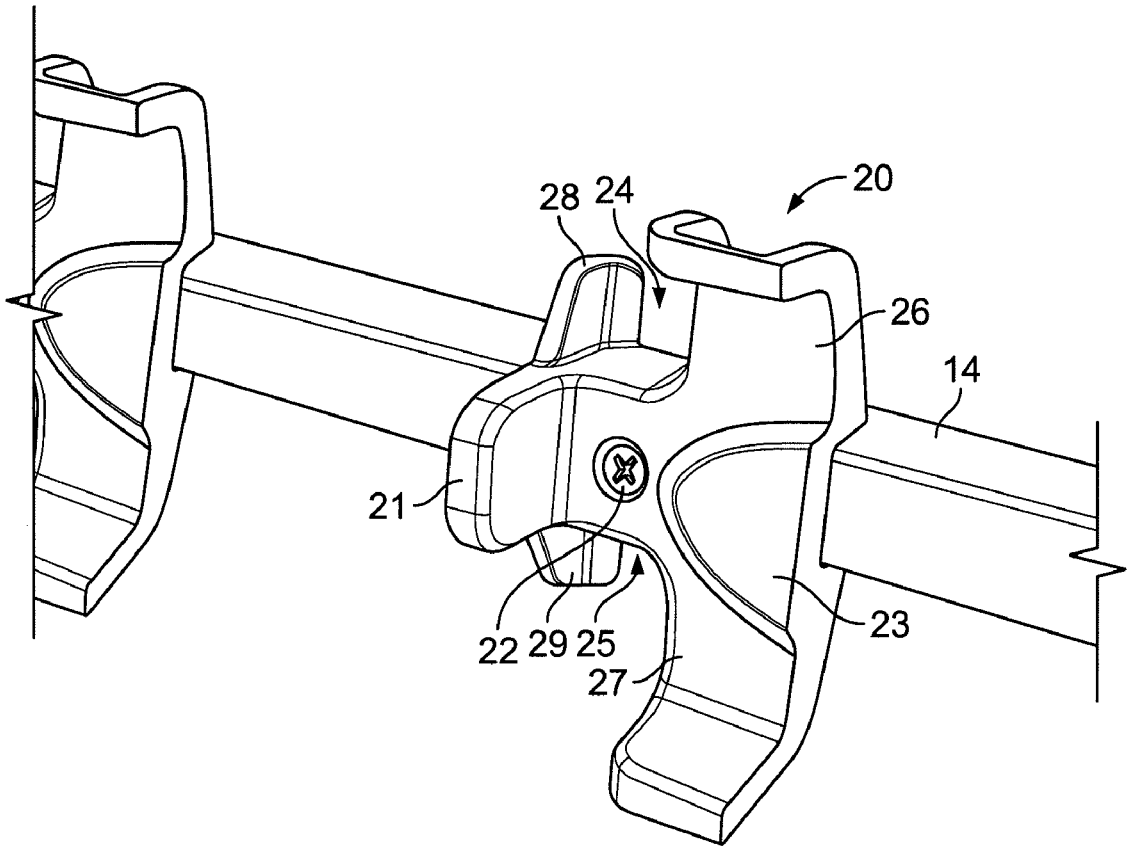
FIGS. 2-5 show enlarged views of a cradle for holding a golf club head according to an embodiment of the invention.
Figure 3:
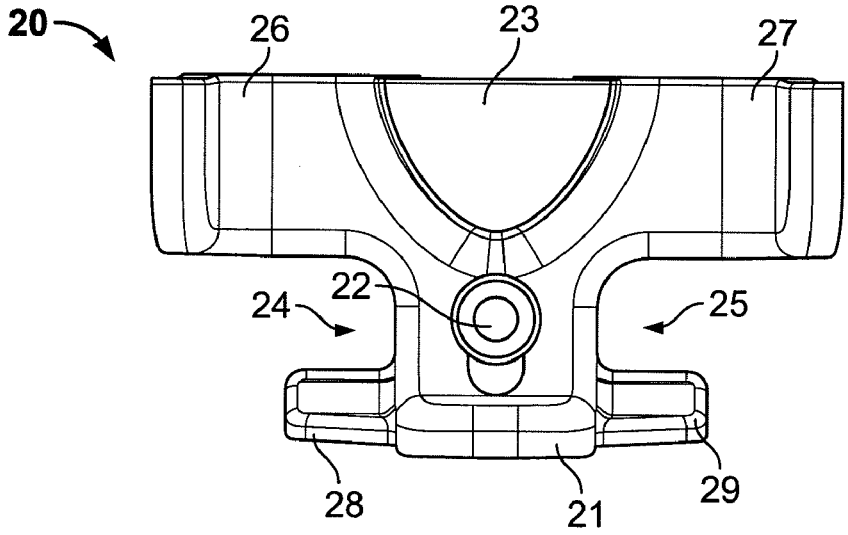
Figure 4:
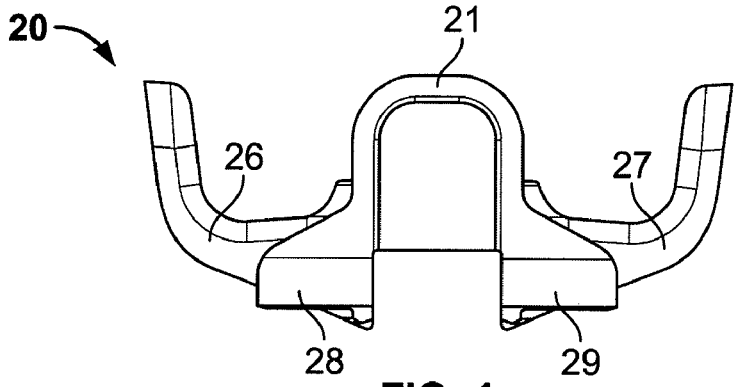
Figure 5:
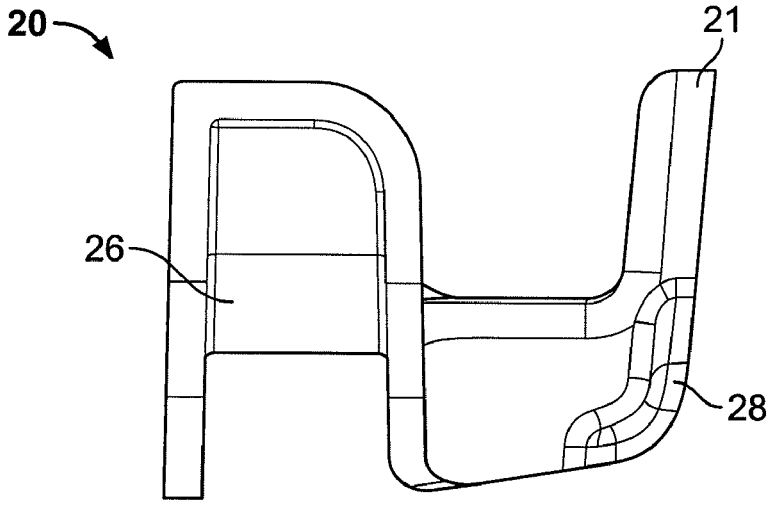

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

It should be further understood that the title of this section of this specification, namely, "Detailed Description of the Invention", relates to a requirement of the United States Patent Office, and does not imply, nor should be inferred to limit the subject matter disclosed therein.

Referring now to FIG. 1, one embodiment of a golf club holder and display 10 is shown having a support member 14 with a plurality of cradles 20 removably attached on a fixed position thereto. Cradles 20 are designed so as to support a golf club head placed thereon. An optional bracket 30 may be disposed on an end of support arm 14 and may be used to mount support arm 14 to a wall or display rack. A plug 40 may be placed at a second end of support arm 14.

Golf club holder and display 10 may comprise varying numbers of cradles 20. FIG. 1 shows golf club holder and display 10 comprising four cradles 20. However, golf club holder and display 10 is easily modified to accommodate a larger or smaller number of cradles 20 spaced in varying configurations as required for the specific application of display 10. Cradles 20 may be spaced along support arm 14 such that there is equal spacing between the cradles 20. Alternatively, cradles may be spaced at varying distances along support arm 14. In this way, the cradles 20 may be adjustable and removable relative to support arm 14.

Support arm 14 may also be of varying length to support a greater number of cradles 20 and to accommodate a desired configuration of display 10 in a specific application. Further, the size and shape of cradles 20 may also vary significantly if required for a specific application. Therefore, support arm 14 can support a combination of different types of cradles for use in a single display. Consequently, golf club holder and display 10 can fit all drivers, fairway woods and hybrids. With minor modifications, other clubs may also be stored and displayed. The golf club holder and display 10 also holds either right-hand or left-hand clubs on the same armature and cradle configuration.

The different materials and manufacturing processes for support arm 14 also vary depending upon the application. For example, support arm 14 may be cast, milled or manufactured using other techniques. Support arm 14 may be made of metal, wood, plastic, a combination of materials, or any other materials that are capable of producing the shape necessary for support arm 14 to hold golf clubs.

As stated above, support arm 14 is adapted to receive a variety of different types of cradles. Referring now to FIGS. 2-5, an enlarged view of an exemplary cradle 20 is shown. Each cradle 20 has a first receiving slot 24, a second receiving slot 25, a first arm 26, a second arm 27, and a means for receiving one or more fasteners to provide for the fasteners 22 to connect cradle 20 to support arm 14. First arm 26 and second arm 27 extend outward from support arm 14 in generally opposite directions. Cradle 20 may also comprise first leg 28, second leg 29, ridge 23 and third arm 21. First leg 28 may extend outwardly from support arm 14 and is generally parallel to first arm 26. Second leg 29 may extend outwardly from support arm 14 and is generally parallel to second arm 27. Third arm 21 may extend outwardly from support arm 14 and is generally orthogonal to both first arm 26 and second arm 27.

In one embodiment, first receiving slot 24 is generally formed between first arm 26 and first leg 28 on one side of cradle 20, and second receiving slot 25 is generally created between a second arm 27 and second leg 29 on a second side of cradle 20. Cradle 20 may also comprise third arm 21 and ridge 23 in order to hold a golf club head in place. Therefore, an embodiment of cradle 20 is adapted to receive both right and left-handed clubs simultaneously, without need for any configuration changes.

In one embodiment, the fasteners 22 may be screws. In other embodiments, other types of fasteners may be used to maintain cradles 20 in a removably fixed position on support arm 14. Support arm 14 may not require holes if the corresponding fasteners do not require holes. In alternate embodiments, fasteners 22 are not required to attach cradles 20 to support arm 14.

The varying materials and manufacturing processes for cradles 20 also vary depending upon the application. For example, cradles 20 may be cast, milled or manufactured using other techniques. Cradles 20 may be made of metal, wood, plastic, a combination of materials, or any other materials that are capable of producing the shape necessary for cradles 20 to hold golf clubs.

Figure 6:
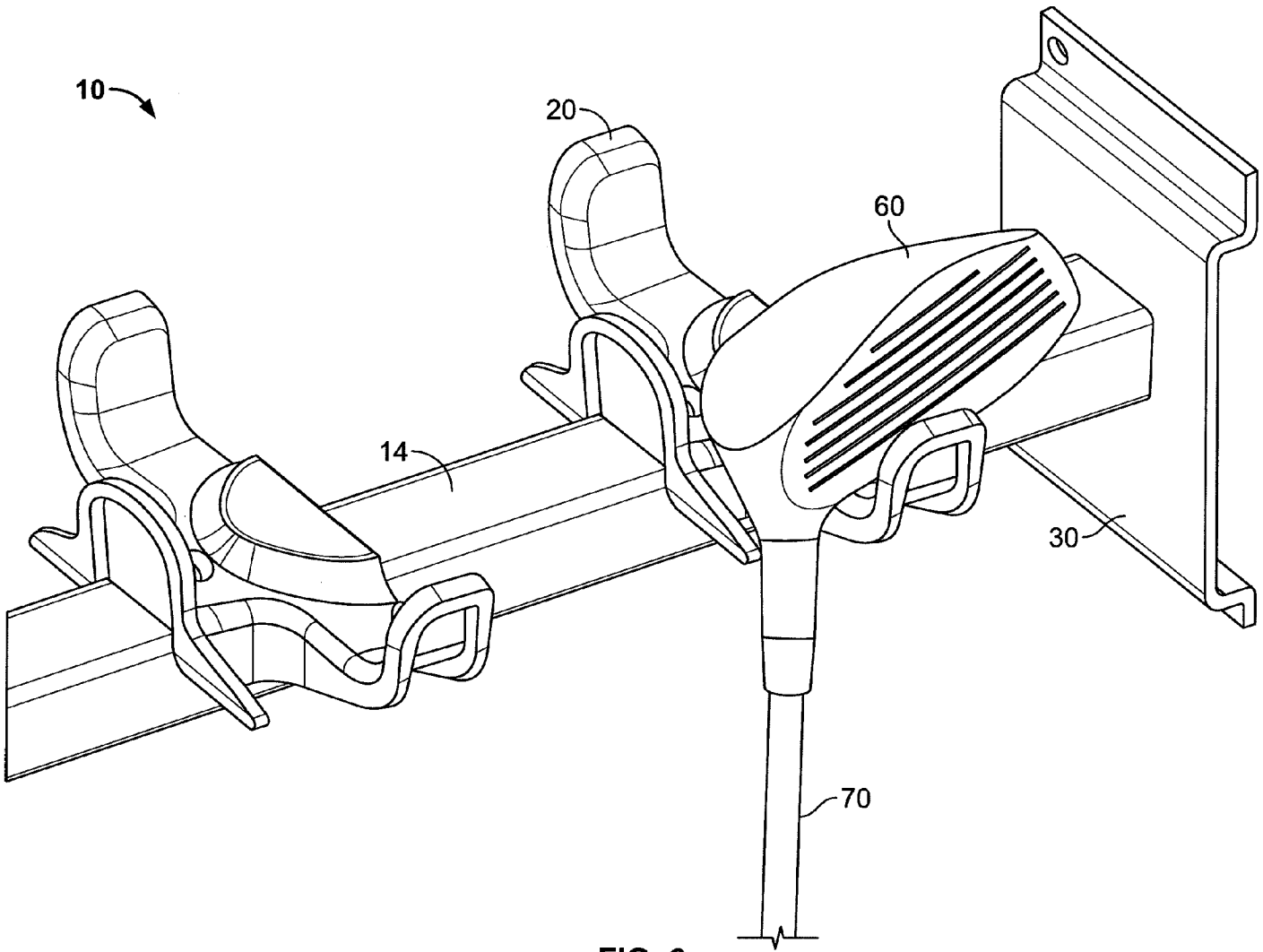
FIG. 6 shows a golf club head resting in a cradle according to an embodiment of the invention.

Referring now to FIG. 6, one golf club in storage and display position within golf club holder and display 10 according to one embodiment is provided. In this embodiment, golf club head 60 rests on a cradle 20, which is attached to support arm 14. Golf club shaft 70 hangs in a downward position relative to support arm 14. Bracket 30 is disposed at one end of support arm 14.

Figure 7:
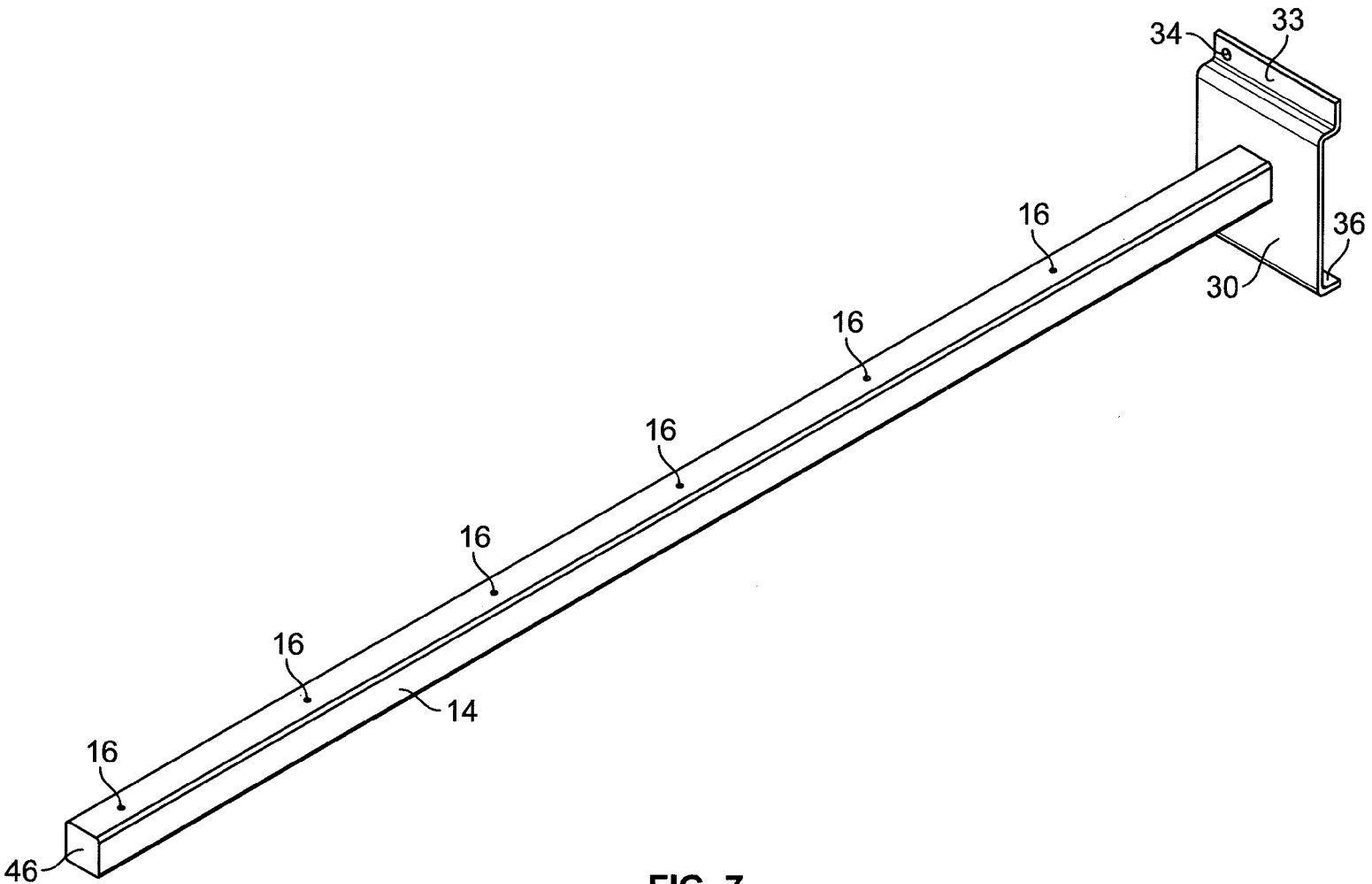
FIG. 7 shows a support arm with all the cradles removed according to an embodiment of the current invention.

Referring now to FIG. 7, support arm 14 with all the cradles removed from support arm 14 according to an embodiment of the current invention is shown. Support arm 14 has multiple holes 16 for receiving fasteners, and a plug hole 46 located at one end of support arm 14 providing means for receiving a plug (not shown) at a first end of the tube. A plug inserted into plug hole 46 can take a variety of shapes and sizes, or may not be present.

A bracket 30 may be disposed at one end of support arm 14. In one embodiment, bracket 30 may have extension 33 having hole 34 and lip 36. During use, bracket 30 may be used to mount display 10 to a merchandise exhibit or display rack, and bracket 30 can be of varying designs to effectuate its function. Bracket 30 allows for easy movement and reconfiguration of the golf club holder and display in a commercial setting.

Figure 8:
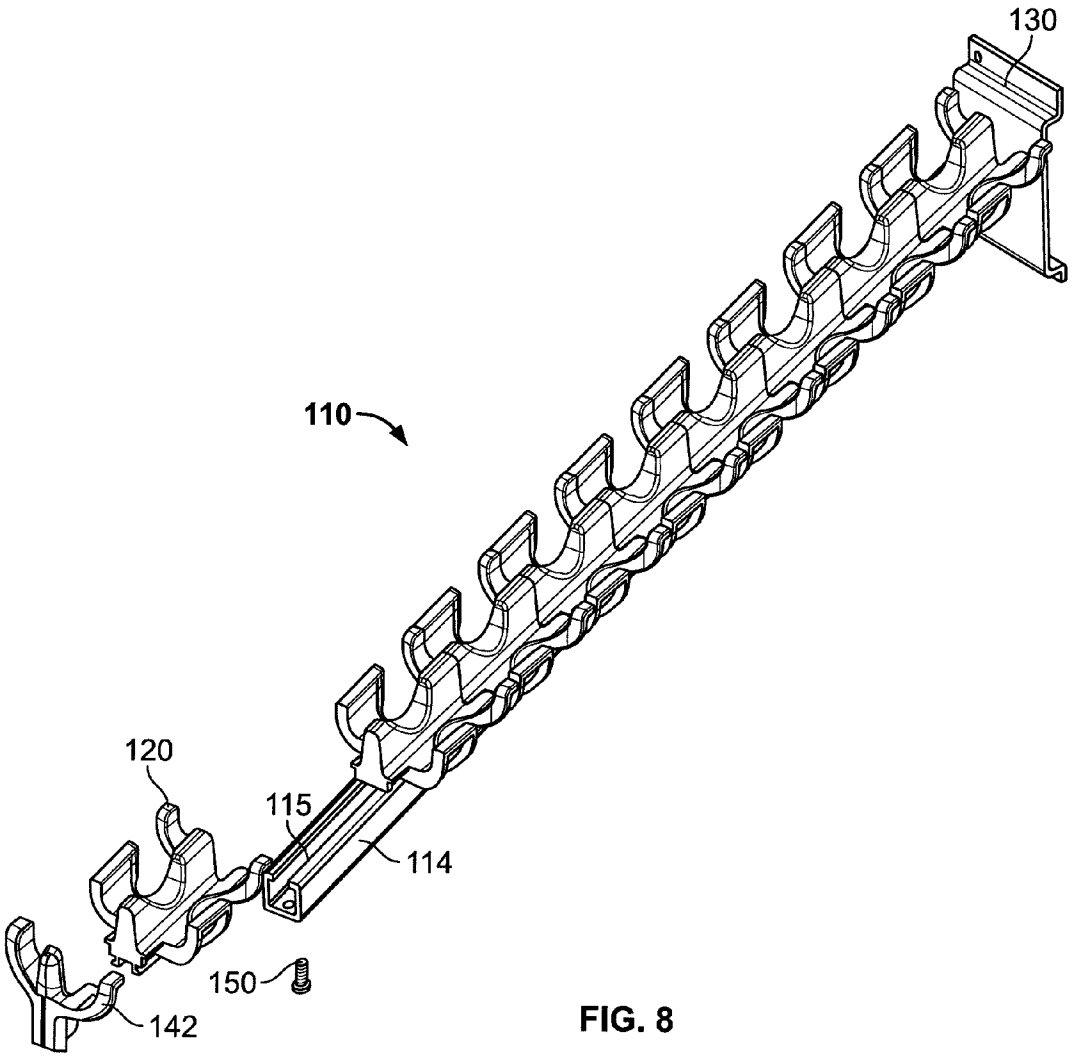
FIG. 8 shows an alternate embodiment of a golf club holder and display, support channel and plurality of cradles.

Referring now to FIG. 8, an alternate embodiment of a golf club holder and display 110 comprising a support arm 114 having a channel receiving portion 115 is provided. Support arm 114 supports a plurality of cradles 120 and cradle cap 142 that are movably secured within support arm 114. Cradle cap 142 is removably fastened to support arm 114 by fastener 150. Disposed at one end of support arm 114 is bracket 130.

In one embodiment, support arm 114 may be mounted at an angle so that one end of support arm 114 is closer to the ground than the opposite end of support arm 114. The angled position of golf club holder and display 10 when in its mounted position provide a waterfall effect which allows for easy viewing of the golf club models. This orientation of golf club holder and display 110 saves space and keeps shafts protected from scratches as clubs hang straight down from the cradles.

In another embodiment, golf club holder and display 110 fits all iron models, over-sized or blade. Further, golf club holder and display 110 also holds either right-hand or left-hand clubs on the same armature and cradle configuration. In yet other embodiments, cradles 120 may be spaced along support arm 114 either with equal spacing between the cradles, or they may be spaced at varying distances along support arm 114. In some applications, support arm 114 may have any number of cradles necessary depending, for example, upon the length of the support arm 114, channel receiving portion 115, and the requirements for display 110 in a specific application. Spacers (not shown) may also be placed in between cradles 120. Similarly, the spacing between cradles 120 may be any dimension required to provide for the specific application required for the golf club holder and display 110. The size and shape of cradles 120 may also vary significantly if required for a specific application. In this way, the cradles 120 may be removable and adjustable relative to support arm 114.

The varying materials and manufacturing processes for cradles 120 also may vary depending upon the application.

For example, cradles 120 may be cast, milled or manufactured using other techniques. Cradles 120 may be made of metal, wood, plastic, a combination of materials or any other materials that are capable of producing the shape necessary for cradles 120 to hold golf clubs.

Figure 9:
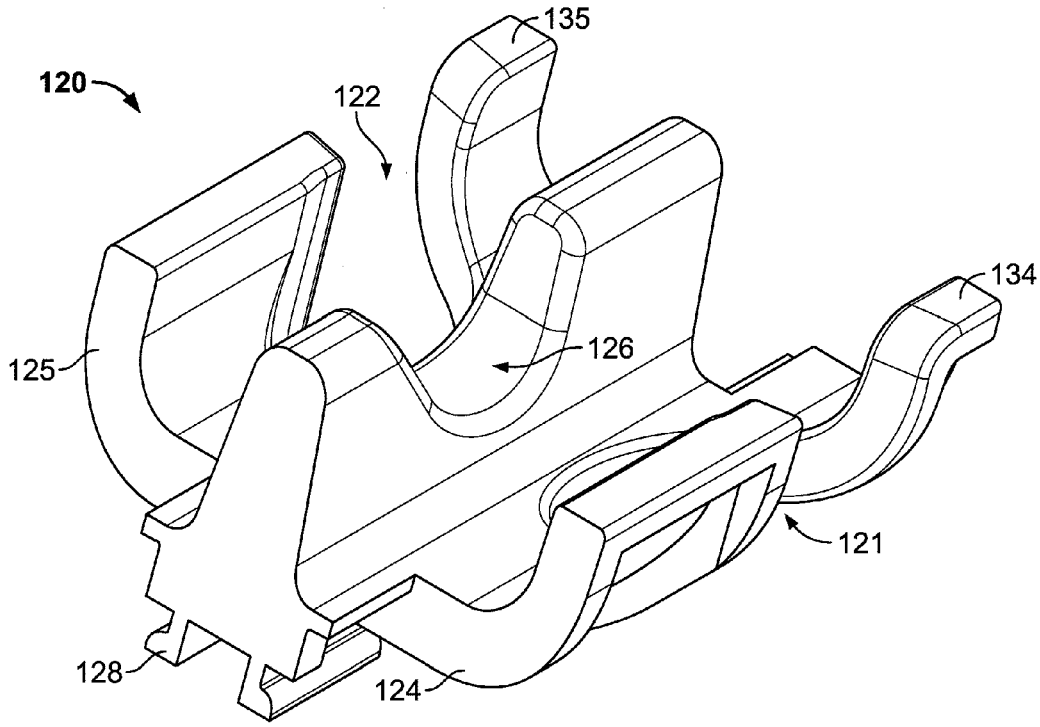
FIG. 9 shows a cradle with a slide mount according to an embodiment of the invention.

Referring now to FIG. 9, an enlarged view of one embodiment of the cradle 120 is shown. The illustrated embodiment of the cradle 120 comprises first receiving slot 121, second receiving slot 122, first arm 124, first leg 134, second arm 125, second leg 135, and recess 126. First receiving slot 121 is generally formed in the space between first arm 124 and first leg 134. Second receiving slot 122 is generally formed in the space between second arm 125 and second leg 135. Some embodiments of cradle 120 may also comprise slide mount 128 that fits into channel receiving portion 115 to enable cradle 120 to slidably mount to support arm 114. In an embodiment of the cradle 120, a golf club head rests in either first receiving slot 121 or second receiving slot 122. Golf club head may also rest in recess 126. Therefore, an embodiment of cradle 120 is adapted to receive both right and left-handed clubs without need for any configuration changes.

In other embodiments of the invention, slide mount 128 may be constructed of a variety of different shapes and may use a variety of different mechanical structures to provide for cradle 120 to be mounted to support arm 114. In some embodiments, cradle 120 may be permanently mounted to support arm 114 or, in yet other embodiments, cradle 120 may be an integrated portion of support arm 114.

Figure 10:
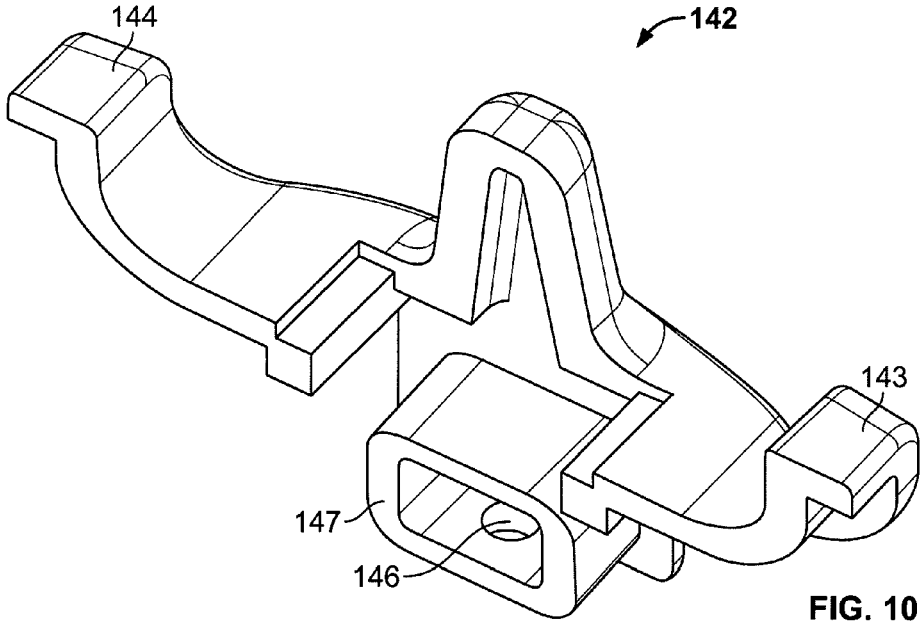
FIG. 10 shows a cradle cap according to an embodiment of the invention.

Referring now to FIG. 10, a cradle cap 142 according to one embodiment is shown. The cradle cap 142 shown comprises plug 147, first arm 143 and second arm 144, whereby hole 146 is disposed in plug 147. A fastener (not shown) for removably securing cradle cap 142 to a support arm through hole 146 may also be used in an embodiment of the invention. Cradle cap 142 also may be slidably mounted to a support arm, and prevents cradles from sliding off an end of the support arm. In some embodiments of the invention, the use of cradle cap 142 is not required.

Figure 11:
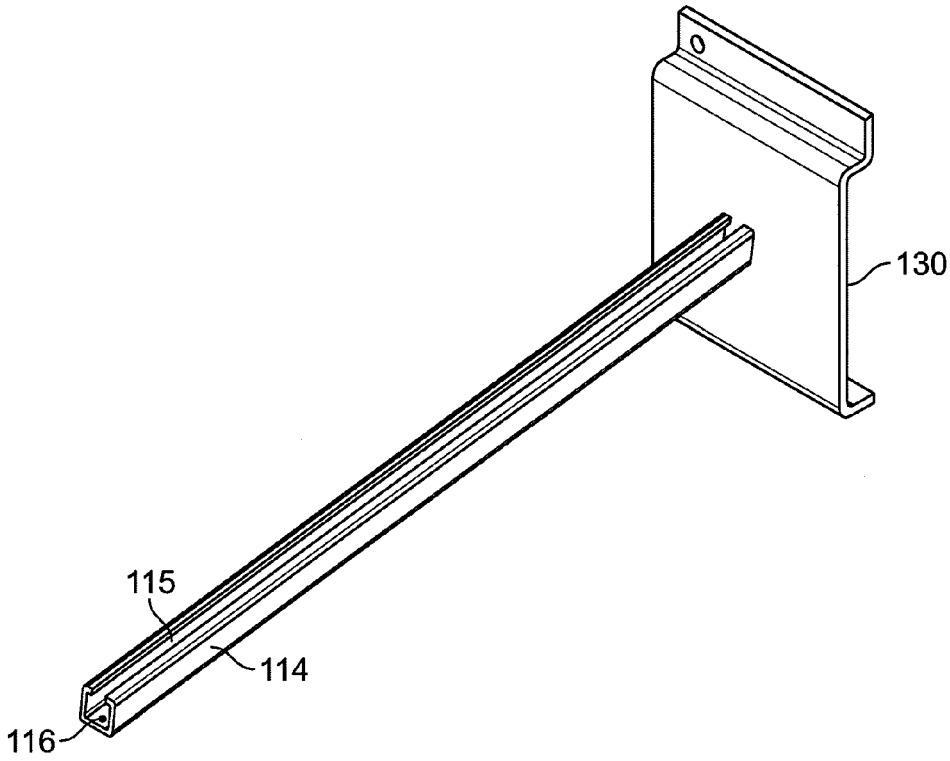
FIGS. 11-13 show a support arm with a support channel with the cradle cap and all cradles removed according to an embodiment of the invention.
Figure 12:
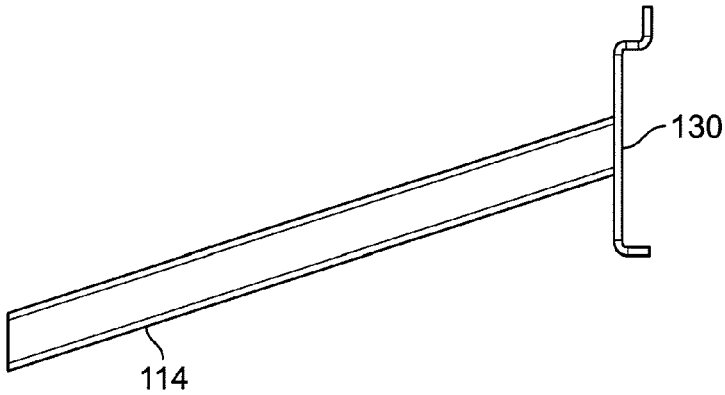
Figure 13:
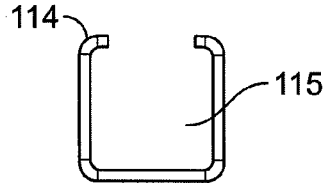

Referring now to FIGS. 11, 12, and 13, one embodiment of the support arm 114 with all cradles and cradle cap removed is shown. FIG. 11, which illustrates an isometric view of support arm 114, and FIG. 13, which is a frontal view of support arm 114, further illustrate an embodiment of the channel receiving portion 115. Opening 116 receives a fastener (not shown) to removably secure a cradle cap. In some embodiments, a fastener is not required to secure a cradle cap, so opening 116 is not present in support arm 114.

FIG. 12 is a side view of support arm 114 according to one embodiment, and it can be seen that when bracket 130 is mounted to a surface, support arm 114 slopes downward relative to bracket 130.

Figure 14:
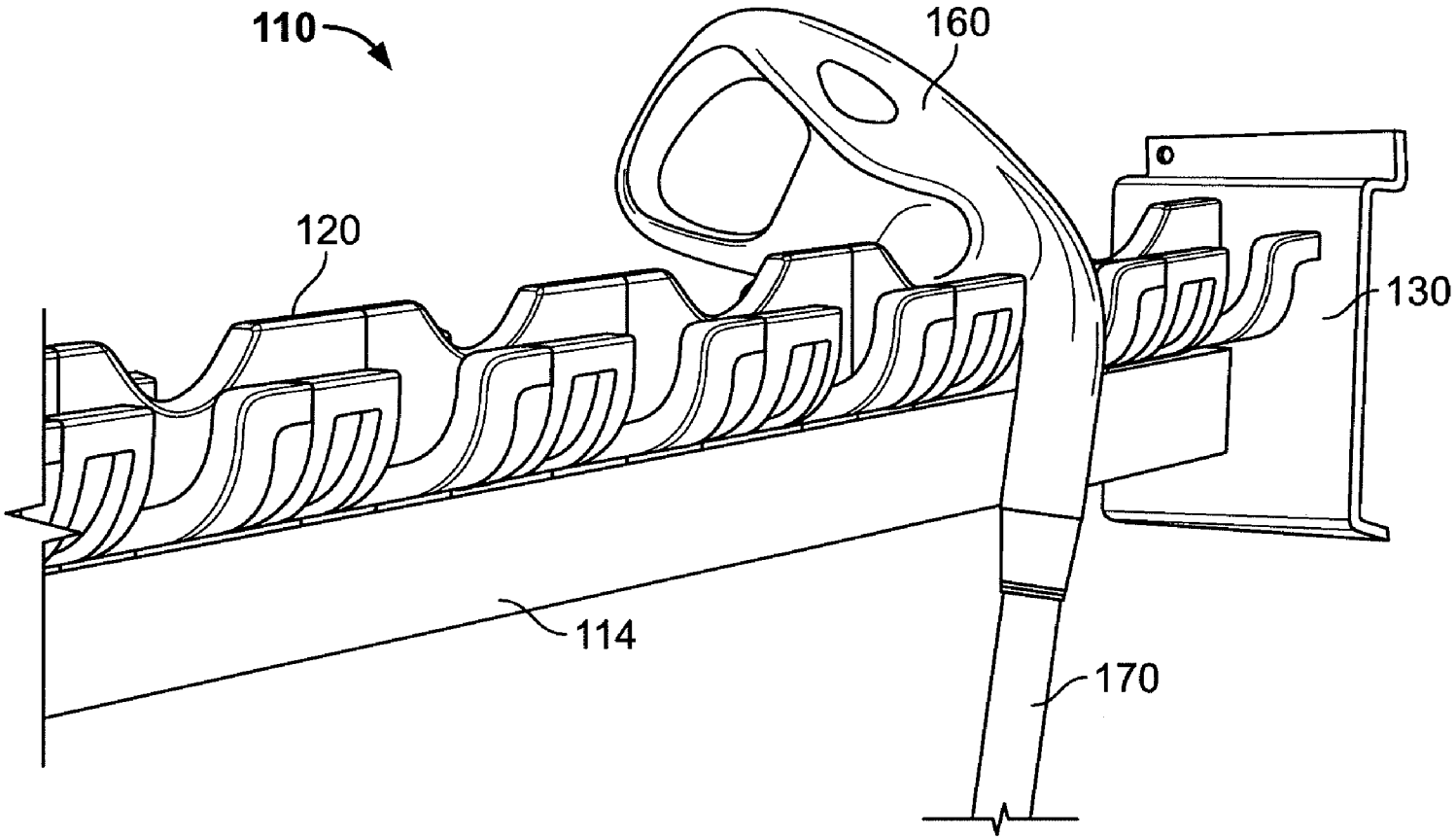
FIG. 14 shows a golf club head resting in a cradle according to an embodiment of the invention.

Referring now to FIG. 14, one golf club in storage and display position within one embodiment of the golf club holder and display 110 is provided. In this embodiment, golf club head 160 rests on a cradle 120, which is attached to support arm 114. Golf club shaft 170 hangs in a downward position relative to support arm 114. Bracket 130 may be disposed at one end of support arm 114.

Figure 15:
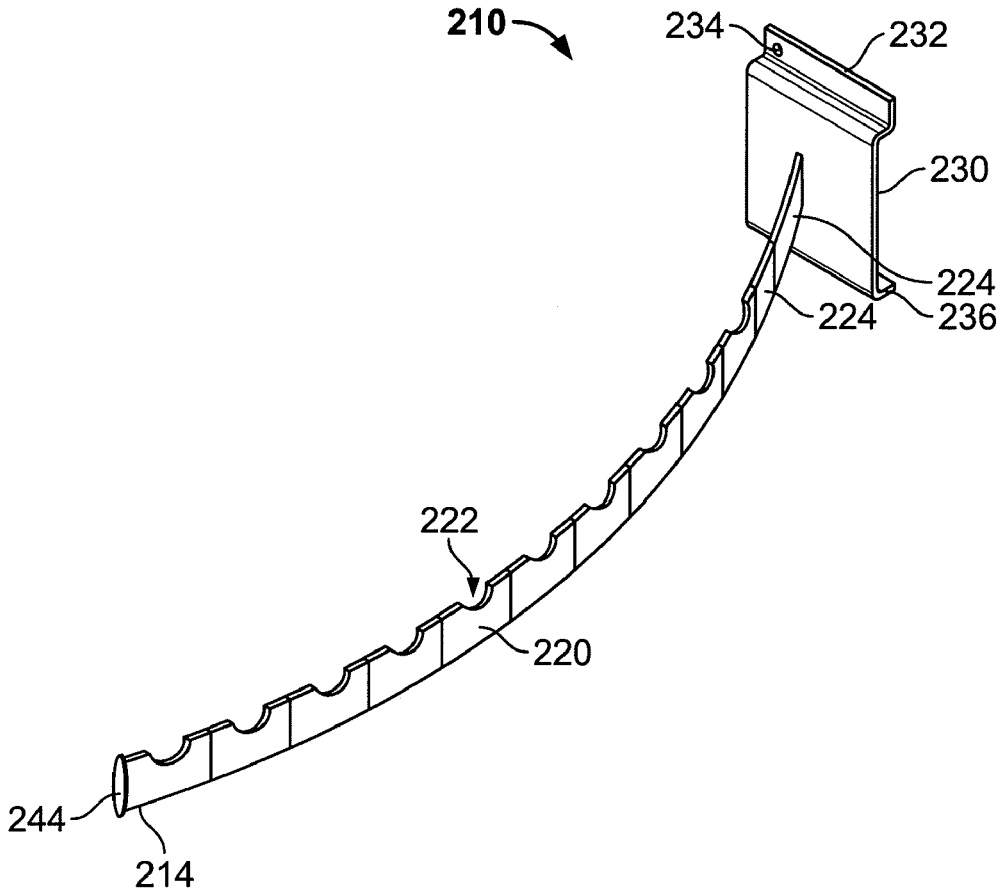
FIGS. 15-17 show an alternate embodiment of a golf club holder and display, an arcuate support member, a plurality of cradles, and a plurality of spacers according to an embodiment of the invention.
Figure 16:
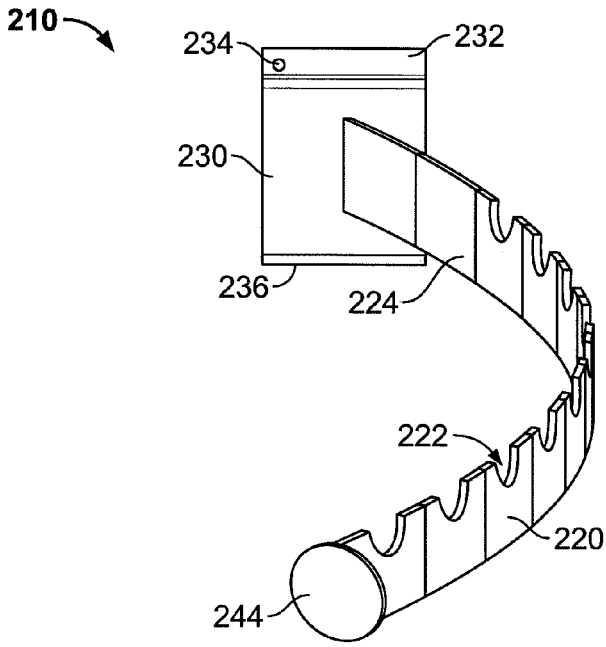
Figure 17:
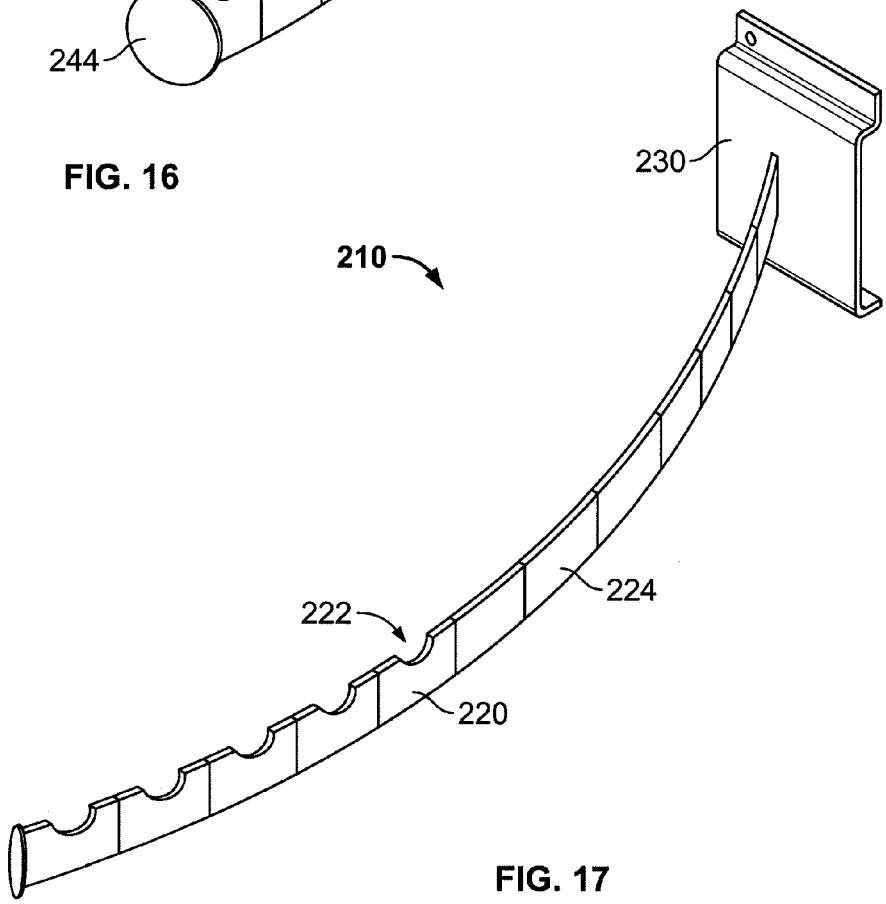

Referring now to FIGS. 15, 16, and 17, an alternate embodiment of a golf club holder and display 210 comprising a support arm 214 comprising multiple cradles 220 and spacers 224 disposed along support arm 214 is provided. A front cap 244 may be disposed at one end of support arm 214. In this embodiment, support arm 214 is arcuate in order to allow easier viewing and removal of golf clubs resting thereupon.

Golf club holder and display 210 is easily modified to accommodate a number of different types of golf clubs, and modifications may be made in various ways. Support arm 214 may be a variety of different lengths and/or shapes and may have different forms of a variety of different bend angles. The embodiment shown in FIG. 15 comprises ten cradles 220, but other embodiments may comprise more or less cradles 220 along support arm 214. In one embodiment, the golf club holder and display 210 may also hold either right-hand or left-hand clubs using the same armature and cradle configuration.

Cradles 220 may be spaced apart in varying configurations as required for the specific application of display 210. In yet other embodiments, cradles 220 may be spaced along support arm 214 either with equal spacing between the cradles or may be spaced at varying distances along support arm 214. In some applications, support arm 214 may have any number of cradles necessary depending upon the length of support arm 214 and the requirements for display 210 in a specific application. Similarly, the spacing between cradles 220 or openings 222 may be any dimension required to provide for the application required for display 210. The size and shape of cradles 220 may also vary significantly if required for a specific application. Also, the size and shape of opening 222, where a golf club rests, may vary depending upon the required specific application. For example, openings 222 may be curved or square in shape. In one embodiment of the invention, cradle 220 may have one or more openings 222 in various shapes. In this way, the cradles 220 may be adjustable and removable relative to support arm 214.

Also shown in the embodiment illustrated in FIGS. 15-17 are spacers 224. Any number of spacers 224 may be provided at any position along support arm 214. Spacers 224 may also be provided between cradles 220. Spacers 224 do not all have to be of the same dimension; spacers 224 of different shapes and sizes may be installed on a single support arm 214 to accommodate to a desired configuration.

In an embodiment of the invention, front cap 244 may be disposed at one end of support arm 214. In yet other embodiments, front cap 244 may be a variety of different shapes and sizes. In still yet other forms, front cap 244 may not be included.

In an embodiment of the invention, a bracket 230 may be disposed on a second end of support arm 214. Bracket 230, in one embodiment, may have extension 232, hole 234 and lip 236. During use, bracket 230 may be provided to mount display 210 to a merchandise exhibit or display rack. Bracket 230 allows for easy movement and reconfiguration of display 210 in a commercial setting.

In an embodiment of the invention, the support member is comprised of cradles 220, and, if the user so desires, the support member is also comprised of spacers 224.

Any of the cradles disclosed above can be designed to work with one support arm system, so that the vendor may select different types of cradles to attach to one support arm. This allows a variety of types of clubs to be displayed, and the vendor may easily switch the cradles if a new configuration is desired.

Specific embodiments of novel methods and apparatus for construction and use of Golf Club Holder and Display according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

The invention claimed is:

1. A display for holding and displaying golf clubs, the display comprising:

a support member having a longitudinal axis; and a cradle, the cradle having a first receiving slot, a second receiving slot, a first arm, a second arm, a first leg, and a second leg, the first receiving slot disposed between the first arm and the first leg and the second receiving slot disposed between the second arm and the second leg, the first receiving slot, the first arm and the first leg being a mirror image of the second receiving slot, the second arm, and the second leg, the cradle configured to support a head of a golf club, with the head resting on and in contact with the cradle, the cradle being mounted to the support member and being symmetrical about the longitudinal axis thereof, the cradle configured to support either a right-handed golf club with a shaft of the club positioned in the first or second receiving slot or a left-handed golf club with a shaft of the club positioned in the other receiving slot, the cradle being configured to support either the right-handed golf club or the left-handed golf club without repositioning the cradle on the support member.

2. The display of claim 1 including a central portion disposed between the first arm, first leg and first receiving slot, and the second arm, second leg and second receiving slot, the central portion separating the first arm, leg and receiving slot from the second arm, leg and receiving slot.

3. The display of claim 2 including a recess formed in the central portion, the recess configured for receipt of the golf club head.

4. The display of claim 1 wherein a plurality of the cradles are disposed along the support member in back-to-back relation to adjacent ones of the cradles.

5. The display of claim 4 including a cap disposed on an end of the support member, the cap configured to maintain the cradles on the support member.

6. The display of claim 4 wherein the cradles are spaced from adjacent cradles on the support member.

7. The display of claim 1 wherein the cradle includes a slide mount, the slide mount enabling the cradle to be slidably mounted to the support member.

8. The display of claim 1 including a bracket attached to an end of the support member and adapted to mount the support member to a surface.

* * * * *